United States Patent [19]

Hellsten et al.

[11] Patent Number: 4,830,739

[45] Date of Patent: May 16, 1989

[54] PROCESS AND COMPOSITION FOR THE FROTH FLOTATION BENEFICIATION OF IRON MINERALS FROM IRON ORES

[75] Inventors: Martin Hellsten, Ödsmål; Marie Ernstsson, Gothenburg, Sweden; Bo Idström, Stenungsund, all of Sweden

[73] Assignee: Berol Kemi AB, Stenungsund, Sweden

[21] Appl. No.: 211,803

[22] Filed: Jun. 27, 1988

Related U.S. Application Data

[60] Division of Ser. No. 135,820, Dec. 21, 1987, Pat. No. 4,795,578, Continuation-in-part of Ser. No. 888,186, Jul. 22, 1986, abandoned, Continuation-in-part of Ser. No. 703,241, Feb. 20, 1985, Pat. No. 4,732,667.

[51] Int. Cl.[4] ..... B03D 1/02

[52] U.S. Cl. ..... 209/166; 252/61

[58] Field of Search ..... 209/166, 167, 902; 252/61; 423/167, 299

[56] References Cited

U.S. PATENT DOCUMENTS

| | | | |
|---|---|---|---|
| 2,382,178 | 8/1945 | Schilling | 209/166 |
| 3,744,629 | 7/1973 | Baarson | 209/166 |
| 4,168,227 | 9/1979 | Polgaire | 209/166 |
| 4,358,368 | 11/1982 | Hellsten | 209/166 |
| 4,421,641 | 12/1983 | Blazy | 209/167 |
| 4,545,898 | 10/1985 | Hellsten | 209/166 |
| 4,612,112 | 9/1986 | Swiatkowski | 209/166 |
| 4,702,823 | 10/1987 | Tesmann | 209/166 |
| 4,732,667 | 3/1988 | Hellsten | 209/166 |

*Primary Examiner*—Kenneth M. Schor
*Assistant Examiner*—Thomas M. Lithgow

[57] ABSTRACT

A process and composition are provided for the froth flotation beneficiation of iron minerals from iron ores containing silicate and phosphate minerals, comprising as collectors a combination of a primary amine and a nitrogen compound containing an anionic group selected from methylene carboxylic acid, ethylene phosphoric acid and methylene phosphonic acid.

2 Claims, 1 Drawing Sheet

Figure 1:
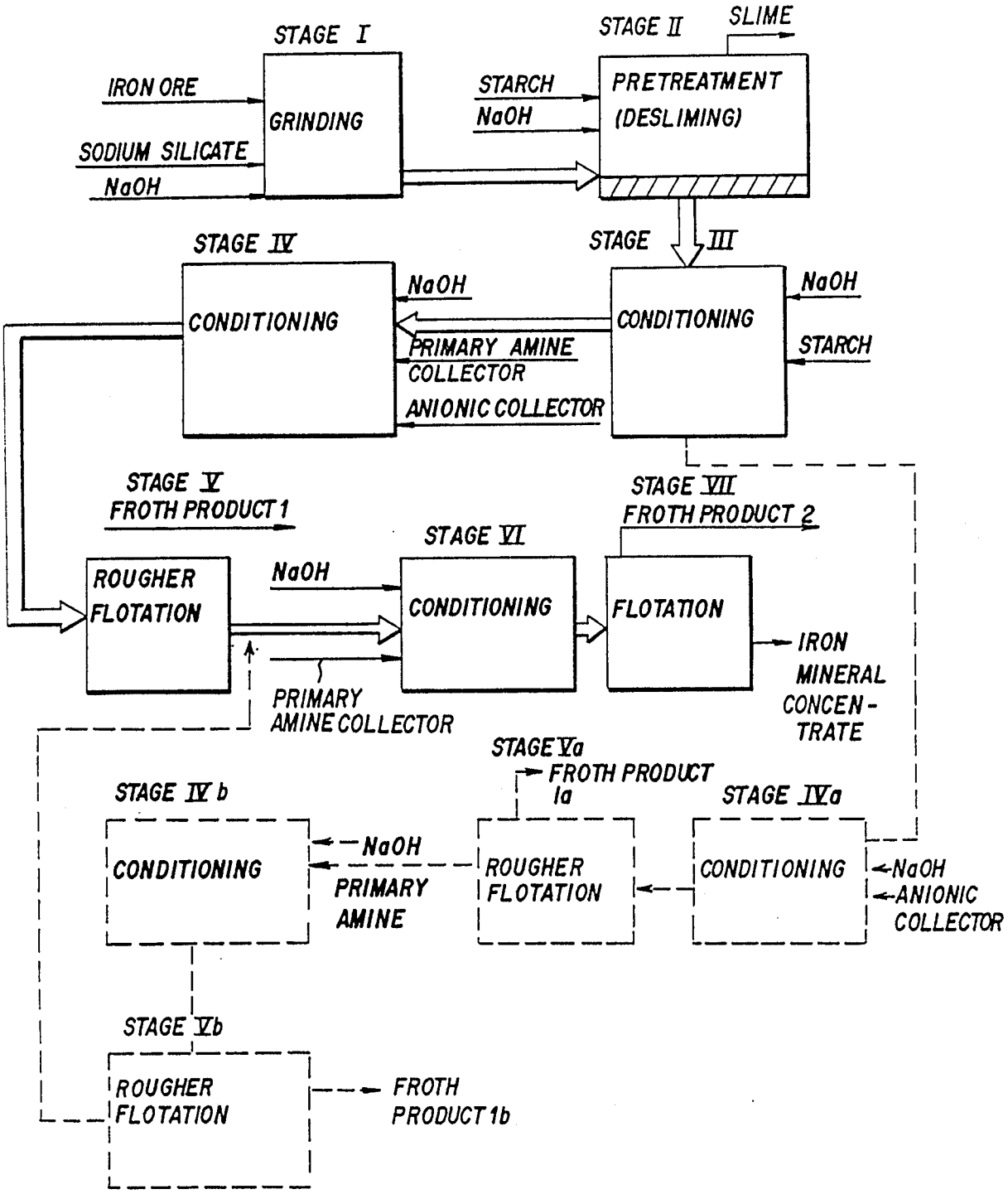

PROCESS AND COMPOSITION FOR THE FROTH FLOTATION BENEFICIATION OF IRON MINERALS FROM IRON ORES

This is a division of application Ser. No. 135,820, filed Dec. 21, 1987, now U.S. Pat. No. 4,795,578, which in turn is a continuation-in-part of Ser. No. 888,186 now abandoned, filed July 22, 1986, which in turn is a continuation-in-part of Ser. No. 703,241, filed Feb. 20, 1985 now U.S. Pat. No. 4,732,667.

Iron ores are commonly subjected to froth flotation to separate the iron minerals, such as hematite, using fatty acids as a collector. However, the selectivity of fatty acids for the iron minerals is accepted as inadequate.

Nowadays an aliphatic amine is used as a selective collector in froth flotation for many gangue minerals such as silicates. In an initial desliming stage and/or in the main froth flotation stage, starch or a starch derivative is added, as a depressant for the iron minerals.

Japanese patent applications Nos. 58-159,856 and 58-156358 suggest use in froth flotation of an aliphatic diamine in combination with a dimer acid or a beta-amino acid. The advantage is claimed to be an unusual high content of iron in the iron concentrate.

While these methods give adequate beneficiation of the iron minerals, small amounts of phosphate minerals are enriched at the same time in the iron mineral concentrates. These small amounts of phosphate minerals (from about 0.05% by weight of phosphor) turn up as unacceptably high contents of phosphorus in the iron product.

Hellsten and Klingberg, U.S. Pat. No. 4,358,368, patented Nov. 9, 1982, provides a process for the froth flotation of calcium phosphate-containing minerals which comprises carrying out the flotation in the presence of an amphoteric flotation agent having the general formula:

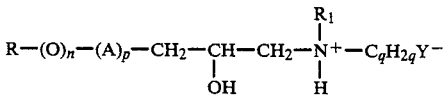

wherein:

R is a hydrocarbon group having from about seven to about twenty-four carbon atoms;

A is an oxyalkylene group having from two to about four carbon atoms;

$R_1$ is selected from the group consisting of hydrogen and hydrocarbon groups having from one to about four carbon atoms;

Y is selected from the group consisting of $COO^-$ and $SO_3^-$;

n is a number from 0 to 1;

p is a number from 0 to 5;

q is a number from 1 to 2;

and salts thereof.

This collector reagent is disclosed in Examples 4 and 5 to be selective for calcium phosphate present with iron minerals and silicates in waste material from magnetically enriched iron ore.

The process and composition of the present invention provide without a concentrate having a lower content of phosphate minerals without a lowered content of iron mineral. Indeed, the iron content in the concentrate may even be increased.

The invention accomplishes this by utilizing as collectors for the gangue minerals a combination of a primary amine and a nitrogen compound having an anionic group selected from the group consisting of methylene carboxylic acid groups, methylene phosphonic acid groups, and ethylene phosphoric acid groups, including, optionally, as a third ingredient, a depressant for the iron materials.

FIG. 1 is a flow sheet showing the froth flotation process in accordance with the invention.

The primary amine has the general Formula I:

in which:

$R_1$ is a hydrocarbon group having from about six to about eighteen carbon atoms;

$n_1$ and $n_2$ are 2 or 3; and $m_1$ is from 0 to 4, preferably 0 or 1 and $m_2$ is from 0 to 2, preferably 0 to 1.

The nitrogen compounds containing an anionic group have the general Formula II:

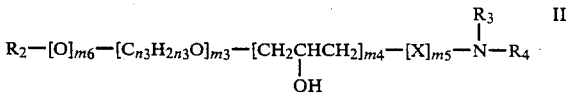

in which:

$R_2$ is a hydrocarbon group having from about one to about twenty-four carbon atoms;

X is a group

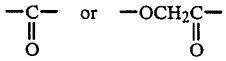

$n_3$ is a number from 2 to 4;

$m_3$ is a number from 0 to 4, and can be an average number;

$m_4$ is 0 or 1;

$m_5$ is 0 or 1;

$m_6$ is 0 or 1;

$R_3$ is selected from the group consisting of hydrogen; hydrocarbon groups having from one to about eighteen carbon atoms; and

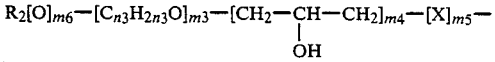

$R_4$ is selected from the group consisting of methylene carboxylic acid $—CH_2COOH$; methylene phosphonic acid

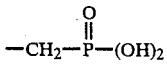

and ethylene phosphoric acid

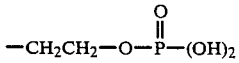

and salts thereof with an inorganic or organic cation.

The anionic group containing compound preferably has a total number of carbon atoms in the hydrocarbon groups of $R_2$ and $R_3$ with the range from about twelve to about twenty-five, and $m_4$ is 1. The number of carbon atoms of each hydrocarbon group in $R_2$ and $R_3$ is preferably within the range from about one to about eighteen.

A preferred class of nitrogen compounds containing an antionic group has the general formula III:

$$R_5-[O]_{m6}-[C_{n3}H_{2n3}O]_{m3}-[CH_2\underset{\underset{OH}{|}}{C}HCH_2]_{m4}-[X]_{m5}-(\overset{\overset{R_6}{|}}{N}-C_pH_{2p})_q-\overset{\overset{R_7}{|}}{N}-C_2H_4OPO_3M_2 \qquad \text{III}$$

in which:

$R_5$ is a hydrocarbon group having from about five to about twenty-four carbon atoms;

X is a group $$-\underset{\underset{O}{\|}}{C}- \quad \text{or} \quad -OCH_2\underset{\underset{O}{\|}}{C}-$$

$n_3$ is a number from 2 to 4;

$m_3$ is a number from 0 to 5, and can be an average number;

$m_4$ is 0 or 1;

$m_5$ is 0 or 1;

when $m_3$ and $m_4$ are 0, $m_6$ is 0;

p and q are numbers from 1 to 3; preferably, p is 2 or 3;

$R_6$ and $R_7$ are selected from the group consisting of hydrogen; hydrocarbon groups having from one to about twelve carbon atoms; and $$R_5[O]_{m6}-[C_{n3}H_{2n3}O]_{m3}-[CH_2-\underset{\underset{OH}{|}}{C}H-CH_2]_{m4}-[X]_{m5}-;$$

$$\overset{\overset{R_6}{|}}{N}-(C_pH_{2p})_q-\overset{\overset{R_7}{|}}{N}$$

can be taken together as

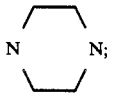

and

M is a monovalent inorganic or organic cation or hydrogen.

One such class of compounds encompassed by Formula III which is easy to produce has the general formula:

$$R_5\overset{\overset{O}{\|}}{C}-\overset{\overset{R_6}{|}}{N}-(C_pH_{2p})_q-\overset{\overset{R_n}{|}}{N}-C_2H_4OPO_3M_2 \qquad \text{III(a)}$$

in which $R_5$, $R_6$, $R_7$ and M have the same meaning as in Formula III, p is 2 or 3, and q is 1 to 3.

Another subclass of Formula III compounds having good flotation properties can easily be produced from α-olefins as starting reactants. These compounds have the formula:

$$R_5CH_2\underset{\underset{OH}{|}}{C}HCH_2(\overset{\overset{R_6}{|}}{N}C_pH_{2p})_q-\overset{\overset{R_n}{|}}{N}-C_2H_4OPO_3M_2 \qquad \text{III(b)}$$

in which $R_5$, $R_6$, $R_7$ and M have the same meaning as in Formula III, p is 2 or 3 and q is 1 to 3.

Another preferred subclass is obtained from a hydroxyl compound and epichlorohydrin. These compounds have the formula:

$$R_5O-[C_{n3}H_{2n3}O]_{m3}-CH_2\underset{\underset{OH}{|}}{C}HCH_2-(\overset{\overset{R_6}{|}}{N}C_pH_{2p})_q-\overset{\overset{R_n}{|}}{N}-C_2H_4OPO_3M_2 \qquad \text{III(c)}$$

in which $R_5$, $R_6$, $R_7$, $m_3$, $n_3$ and M have the same meaning as in Formula III, p is 2 or 3 and q is 1 to 3.

Another subclass of compounds within Formula III has the formula:

$$R_5-(\overset{\overset{R_6}{|}}{N}C_pH_{2p})_q-\overset{\overset{R_n}{|}}{N}-C_2H_4OPO_3M_2 \qquad \text{III(d)}$$

in which $R_5$, $R_6$, $R_7$ and M have the same meaning as in Formula III, p is 2 or 3, and q is 1 to 3.

Still another such class of compounds having good flotation properties and easy to produce has the general formula:

$$R_5-[O]_{m6}-[C_{n3}H_{2n3}O]_{m3}-[CH_2\underset{\underset{OH}{|}}{C}HCH_2]_{m4}-[X]_{m5}-N\begin{matrix}\diagup CH_2-CH_2 \diagdown \\ \diagdown CH_2-CH_2 \diagup\end{matrix}N-C_2H_4OPO_3M_2 \qquad \text{III(e)}$$

in which $R_5$, X, $m_3$, $m_4$, $m_5$, $n_3$ and M have the same meaning as in Formula III.

Exemplary $R_1$, $R_2$, $R_3$, $R_5$, $R_6$ and $R_7$ hydrocarbon groups include aliphatic hydrocarbon groups (which are preferred as $R_1$) such as methyl, ethyl, propyl, isopropyl, butyl, isobutyl, tert-butyl, amyl, isoamyl, tert-amyl, sec-amyl ($R_3$ only), hexyl, isohexyl, tert-hexyl, sec-hexyl, heptyl, octyl, isooctyl, 2-ethyl hexyl, nonyl, isononyl, tert-nonyl, decyl, isodecyl, dodecyl, tetradecyl, hexadecyl, octadecyl, octadecenyl, linoleyl, linolenyl, and behenyl; cycloaliphatic hydrocarbon groups, such as cyclopropyl; cyclobutyl; cyclopentyl; cyclohexyl; cycloheptyl; and cyclooctyl; and aromatic hydrocarbon groups, such as phenyl, methyl phenyl, dimethyl phenyl, propyl phenyl, butyl phenyl, octyl phenyl, nonyl phenyl, and dodecyl phenyl.

Especially preferred amines of Formula I are those amines in which $R_1$ is aliphatic and $m_2$ is 0. These primary amines are known compounds.

Exemplary $\text{-}[C_{n1}H_{2n1}O]\text{-}$ and $\text{-}[C_{n3}H_{2n3}O]\text{-}$groups include ethyleneoxy; propyleneoxy-1,2; butyleneoxy-2,3; and butyleneoxy-1,2 ($C_{n3}H_{2n3}O$ only).

Exemplary primary amines include:

$C_{10}H_{21}—NH_2$ $C_{10}H_{21}O(CH_2)_3NH(CH_2)_3NH_2$ $(C_{8\text{-}10}H_{17\text{-}21})—O(CH_2)_3—NH_2$ $C_7H_{15}NHCH_2CH_2CH_2NH_2$ $C_{14}H_{29}OCH_2CH_2CH_2NHCH_2CH_2NH_2$ $C_{18}H_{37}OC_2H_4OC_2H_6NH_2$ $C_{18}H_{34}OCH_2CH_2CH_2NHCH_2CH_2NH_2$ $C_{16}H_{33}(OC_2H_4)_2OC_3H_6NH_2$ $C_8H_{17}OCH_2CH_2CH_2NH$ $C_{16}H_{33}(OC_2H_4)_3OC_3H_6NHC_3H_6NH_2$ $C_{12}H_{25}OCH_2CH_2CH_2NHCH_2CH_2NH_2$ $$C_{18}H_{37}NHCH_2\underset{\underset{CH_3}{|}}{CH}—NH_2$$

Exemplary nitrogen compounds containing an anionic group include:

$$(C_8H_{17}—OCH_2\underset{\underset{OH}{|}}{CH}CH_2)_2—NCH_2COOH$$

$$C_{13}H_{27}—OCH_2\underset{\underset{OH}{|}}{CH}CH_2\underset{\underset{CH_3}{|}}{N}—CH_2COOH$$

$$[C_9H_{19}CH_2\underset{\underset{OH}{|}}{CH}CH_2]_2NCH_2CH_2O\underset{\underset{O}{\|}}{P}(OH)_2$$

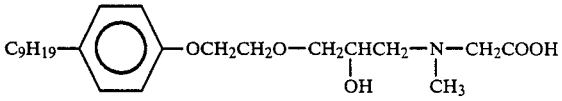

$$C_8H_{17}—CH{=}CH—C_7H_{15}—\overset{\overset{O}{\|}}{C}—\overset{\overset{CH_3}{|}}{N}—CH_2COOH$$

$$(C_8H_{17})_2—NCH_2PO_3H_2$$

$$(C_8H_{17}—OCH_2\underset{\underset{OH}{|}}{CH}CH_2)_2—NCH_2CH_2OPO_3H_2$$

$$(C_8H_{17})_2—NCH_2CH_2OPO_3H_2$$

$$(\text{2-ethyl hexyl-}OCH_2\underset{\underset{OH}{|}}{CH}CH_2)_2—NCH_2CH_2OPO_3H_2$$

$$\text{iso-}C_6H_{13}[OCH_2CH_2]_4—OCH_2\underset{\underset{OH}{|}}{CH}—CH_2—OCH_2\underset{\underset{O}{\|}}{C}NHCH_2COOH$$

$$C_{18}H_{35}[OCH_2CH_2]_3—O—CH_2\underset{\underset{OH}{|}}{CH}—CH_2\underset{\underset{CH_3}{|}}{N}CH_2COOH$$

$$C_{18}H_{37}[OCH_2CH_2]_4OCH_2\underset{\underset{OH}{|}}{CH}—CH_2NHCH_2\underset{\underset{O}{\|}}{P}(OH)_2$$

$$C_{16}H_{33}OCH_2CH_2OCH_2\underset{\underset{OH}{|}}{CH}CH_2\underset{\underset{CH_3}{|}}{N}CH_2CH_2O\underset{\underset{O}{\|}}{P}(OH)_2$$

$$[C_{10}H_{21}OCH_2\underset{\underset{OH}{|}}{CH}—CH_2]_2NCH_2COOH$$

$$[\text{iso-}C_7H_{15}—O—CH_2CH_2OCH_2\underset{\underset{OH}{|}}{CH}CH_2]_2NCH_2\underset{\underset{O}{\|}}{P}(OH)_3$$

$$\text{tert-}C_8H_{17}—[O\underset{\underset{CH_3}{|}}{CH}CH_2]_2OCH_2\underset{\underset{OH}{|}}{CH}CH_2\underset{\underset{C_8H_{17}}{|}}{N}—CH_2COOH$$

-continued

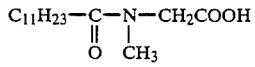

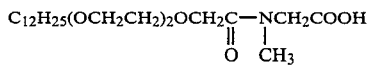

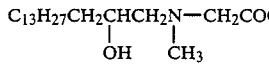

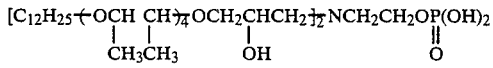

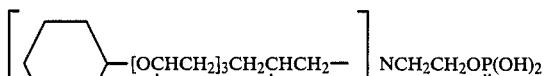

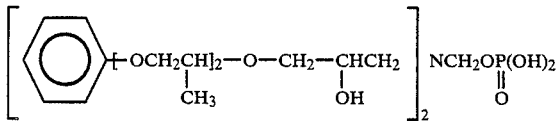

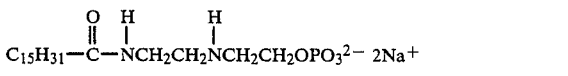

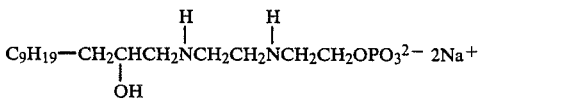

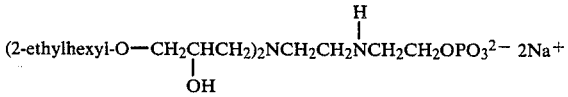

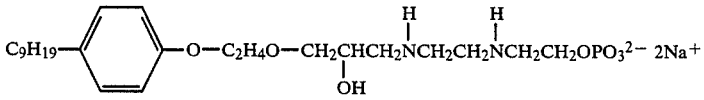

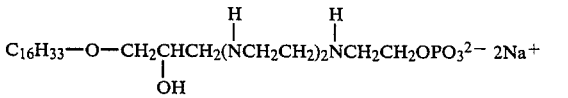

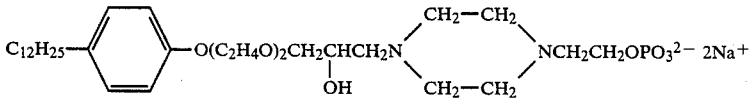

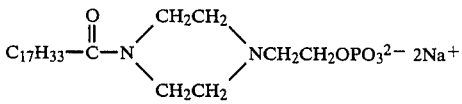

If mixtures of two or more types of minerals are subjected to froth flotation using two ionic collectors of opposite charge, very often problems occur, since the collectors may interfere with each other. The interference may result in larger reagent consumption, frothing problems, and high losses of the valuable mineral, in this case, the iron mineral. However, in the process of the present invention, none of these drawbacks occurs.

While in general it is more efficient to utilize the primary amine and the anionic group containing collectors together, in admixture, they can be used separately, in sequential steps.

Each of the collectors is normally added in an amount within the range from about 5 to about 250 g per ton of ore, preferably within the range from about 5 to about 100 g per ton of ore.

The compound containing the anionic group can be produced from commercially available starting compounds using known methods, such as disclosed in U.S. Pat. No. 4,358,368, patented Nov. 9, 1982.

The group $R_2$ if aliphatic is derived from an alcohol, such as Ziegler, Oxo and fatty alcohols, for example, butanol, iso-butanol, secondary-butanol, hexanol, secondary-hexanol, iso-hexanol, 2-ethyl hexanol, octanol, lauryl alcohol, myristyl alcohol, cetyl alcohol, stearyl alcohol, oleyl alcohol, and behenyl alcohol.

When $R_2$ is cycloaliphatic or aromatic, cycloaliphatic alcohols and aromatic phenols can be utilized as the starting material. Suitable cycloaliphatic alcohols are cyclopropanol, cyclobutanol, cyclopentanol, cyclohexanol, cycloheptanol, and alkylsubstituted cycloalcohols. Suitable aromatic phenols include synthetically manufactured mono- and dialkyl-substituted phenols, such as octyl phenol, nonyl phenol, dodecyl phenol, and dibutyl phenol, and tributyl phenol.

The $R_3$, $R_6$ and $R_7$ hydrocarbon group or hydrogen and/or the $R_4$ acid group can be introduced using a compound having the Formulae IV, V, VI or VII:

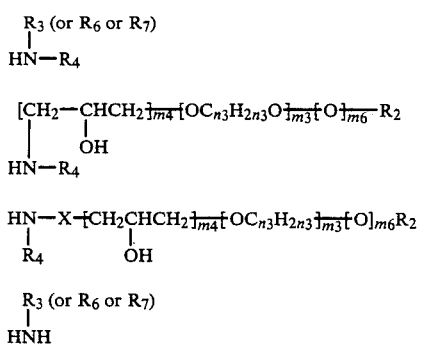

(IV)

(V)

(VI)

(VII)

in which $R_3$, $R_4$, $R_6$, $R_7$, $m_3$, $m_4$, $m_5$ and $m_6$ are as above in Formulae II and III. Tertiary amines in which $R_3$, $R_6$ and $R^7$ is methyl, 2-ethyl hexyl, decyl, or an isomer thereof or phenyl and $R_4$ is

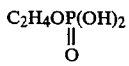

are preferred.

When $R_3$, $R_6$ or $R_7$ is the group having the formula

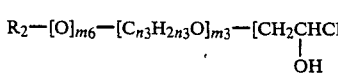

the tertiary amine can be obtained by reacting two moles of the alkylene oxide having the formula

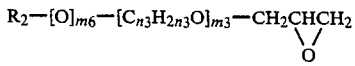

with one mole of the amine having the formula $H_2NR_4$.

The groups $[C_{n3}H_{2n3}O]_{m3}$ and $[CH_2CHOHCH_2]_{m4}$ can be introduced by conventional methods by reacting a suitable starting compound with alkylene oxide and epichlorohydrin. The group

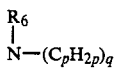

can be introduced by using ethylene diamine, diethylene triamine, triethylene tetramine and the corresponding propylene amines as well as alkylsubstituted derivates thereof as reactants. As an alternative, it is possible to use acrylonitrile as a reactant and then hydrogenate.

The flotating properties of the amphoteric compound can be further improved by the presence of a hydrophobic secondary collector, preferably in the form of a polar, water insoluble, hydrophobic substance with affinity to the mineral particles coated with the amphoteric compound. The amphoteric compound is usually added in an amount of from 10 to 1000, preferably from 50 to 500 grams per metric ton of ore and the polar, water insoluble, hydrophobic substance in an amount from 0 to 1000, preferably from 5 to 750 grams per metric ton of ore. In the case where the amphoteric compound is used in combination with the hydrophobic substance the ratio between them may be varied within wide limits but normally it is within the interval from 1:20 to 20:1, preferably from 1:5 to 5:1. The water insoluble hydrophobic substance, which according to the invention may be characterized as a secondary collector, consists preferably of a polar substance. If desired, a conventional emulsifier dissolved in a hydrocarbon can also be added in order to obtain a stable emulsion in water and a good distribution. The emulsifier may be a nonionic surface active compound, which in the case it is water insoluble is to be included in the polar substance. Suitable polar components are water insoluble soaps such as calcium soaps; water insoluble surface active alkylene oxide adducts; organic phosphate compounds, such as tributyl phosphate, tri-(2-ethylhexyl)-phosphate; and esters of carboxylic acids, such as tributyl ester and tri(2-ethyl hexyl)ester of NTA as well as dioctylphthalate.

In the froth flotation process of the invention the amphoteric collector can also be and preferably is utilized in combination with a depressant.

The depressant can be any conventional mineral depressant, such as a hydrophilic polysaccharide. Suitable hydrophilic polysaccharides include cellulose esters, such a carboxymethyl cellulose and sulphomethyl cellulose; cellulose ethers, such as methyl cellulose, hydroxyethyl cellulose, hydroxymethyl cellulose, and ethyl hydroxyethyl cellulose; the hydrophylic natural gums, such as gum arabic, gum karaya, gum tragacanth; and gum ghatti; the alginates; and starch, such as corn starch, and starch derivatives, such as carboxymethyl starch and starch phosphate. Polysaccharides having anionic groups are preferred.

The depressant should be present in the mineral pulp before each flotation process in a sufficient amount to prevent the iron mineral from floating. Normally, the amount of depressant is within the range from about 10 to about 1000 grams per ton ore, but this amount is not critical.

In flotation pH regulators can also be added, as well as activators. In most flotations, the pH is of importance in obtaining a good separation, and process to optimize the separation of different minerals by the selection of a suitable pH. The character of the amphoteric compound varies considerably with pH. At a pH below 6, it is mainly cationic, while it is chiefly anionic at pHs above 10, and zwitterionic at pH's between 6 and 10. In the separation of ore containing apatite and silicate or apatite and calcite, an excellent, selective enrichment is obtained, if the flotation process is carried out at a pH from about 8 to about 11. Conventional frothers and activators can also be added. Each ore has to be treated in accordance with its own chemical and physical composition.

The primary amine and the anionic group containing compound can be combined and marketed as a collector composition, ready for addition to the ore at the froth flotation step, in the desired proportion to each other. The amines can be in liquid form, in solution in water or a water-miscible inert solvent. The amines can be solubilized as the acid salt with an inorganic acid, such as hydrochloric acid, sulfuric acid, nitric acid, acetic acid or formic acid, or the secondary or tertiary amine as the salt of the carboxylic acid or phosphoric acid group with an alkali metal hydroxide such as sodium hydroxide or ammonia. Solid amines can be marketed in solid form.

The relative proportions of the primary amine and secondary or tertiary amine are not critical, and can normally be within the range from 4:1 to 1:4, preferably from 2:1 to 1:2.

In the process shown in the flow sheet of FIG. 1, the primary amine and tertiary amine collector are present together in the rougher flotation step, which is a preferred process due to the simplicity of the equipment.

Compounds according to the invention generally show good properties in flotation of oxide or salt type minerals, such as apatite may well be used when enriching iron minerals from phosphor containing ores in combination with a primary amine as a silicate collector.

FIG. 1 shows a flow sheet of such a froth flotation process.

As seen in FIG. 1, in Stage I the iron ore, together with water, sodium hydroxide and sodium silicate, are ground to a particle size suitable for froth flotation. The ground ore slurry then passes to Stage II, where the ore is pretreated with starch and sodium hydroxide to adjust pH, resulting in slime formation. The slime rises to the surface of the slurry, and is removed. The ore is then conditioned for several minutes in Stage III, with addition of more sodium hydroxide to adjust pH, and starch, and then in Stage IV the primary amine and secondary and/or tertiary amine collectors are added with more sodium hydroxide to adjust pH, and conditioned for several more minutes. The slurry is subjected to a rougher flotation in Stage V. The gangue at the surface is removed as Froth Product I, and the bottom iron mineral concentrate passed to the Stage VI conditioning, after addition of more primary amine, and sodium hydroxide to adjust pH. After conditioning for several minutes, there follows a second froth flotation, separating a Froth Product 2, and recovering the iron mineral concentrate product.

If desired, the primary amine and secondary or tertiary amine can be used in separate steps, shown in dashed lines in FIG. 1. In this case, primary amine only is added with sodium hydroxide in Stage IV a, followed by a rougher flotation Stage Va, and then secondary or tertiary amine is added with sodium hydroxide in Stage IVb, followed by a rougher flotation in Stage Vb. The other stages are as in solid lines in FIG. 1.

The froth flotation processing conditions form no part of the invention and are entirely conventional. The conditioning and flotation steps can be carried out at room or ambient temperature, but elevated temperatures can be used, up to about 100° C., or the volatilization temperature of the amine, if lower. The pH is usually on the alkaline side, and preferably between pH 8 and pH 12.

The following Examples represent preferred embodiments of the process of the invention.

EXAMPLES 1 TO 13

Froth flotations were carried out in accordance with the flow sheet shown in FIG. 1.

An iron ore containing Fe 34%, Si 23.9% and P 0.044%, mainly present as hematite 49%, silicate (quartz) 51%, and apatite 0.24%, was crushed to particles less than 1.7 mm in diameter and homogenized. From the homogenized material portions of 600 grams each were taken out. The portions were further ground in a laboratory rod mill for 30 minutes together with 400 ml of water, 0.40 g sodium hydroxide and 0.27 g water glass (38% sodium silicate by weight, weight ratio $SiO_2/NaO_2=3.22$, 41.0° Bé).

The particle distribution was such that 97% by weight passed through a 32 μm mesh sieve.

An aqueous mineral pulp 8 liters in volume was prepared from each portion of the ground material. Temperature and pH were adjusted to about 20° C. and 10.5, respectively. 0.0675 g of prehydrolyzed corn starch was added, and the whole was conditioned in a paddle mixer for 2 minutes.

The conditioned pulp was allowed to settle for 3 minutes, and then the slime was siphoned off. The deslimed pulp was divided into four fractions, and each fraction transferred to a flotation cell and diluted with water to a volume of 0.5 llter. The pH was adjusted to 10.5 with sodium hydroxide, followed by the addition of 0.0675 g of the prehydrolyzed corn starch. After conditioning for 2 minutes, and a final pH adjustment to 11.0, the secondary or tertiary amine and primary amine collectors were added. The amount of the primary amine was 0.0067 g, and the amount of the secondary or tertiary amine is given in Table I. After an additional conditioning for 2 minutes, a rougher flotation was carried out, giving a Froth Product 1 and a bottom iron mineral concentrate. The pH was again adjusted to 11 with sodium hydroxide, 0.0067 g of primary amine was added to the bottom concentrate, and the whole conditioned for 2 minutes, followed by another froth flotation, giving a Froth Product 2, and iron mineral concentrate. The primary and secondary or tertiary amines used and the results obtained are shown in Table I.

TABLE I

| Example No. | Anionic Collector | g/ton | Primary Amine Collector | Feed % P Assay | Slimes % Wt. | Deslimed Pulp % P Assay | Iron mineral concentrate % Wt. | % Fe Grade | % Fe Recovery | % $SiO_2$ Assay | % P Assay | P distributed in % of flotation feed |
|---|---|---|---|---|---|---|---|---|---|---|---|---|
| Control | None | — | $(C_{8-10}H_{17-21})—O(CH_2)_3—NH_2$ | 0.043 | 32.2 | 0.033 | 37.9 | 66.0 | 74.7 | 5.8 | 0.048 | 81.6 |
| 1 | $(C_8H_{17}—OCH_2CH(OH)CH_2)_2—NCH_2COOH$ | 54 | $C_{10}H_{21}—NH_2$ | 0.045 | 32.4 | 0.037 | 38.8 | 67.0 | 77.7 | 4.3 | 0.034 | 52.0 |
| 2 | $(C_8H_{17}—OCH_2CH(OH)CH_2)_2—NCH_2COOH$ | 54 | $C_{10}H_{21}O(CH_2)_3NH(CH_2)_3NH_2$ | 0.044 | 32.4 | 0.035 | 41.1 | 65.2 | 80.0 | 6.7 | 0.034 | 58.6 |
| 3 | $(C_8H_{17}—OCH_2CH(OH)CH_2)_2—NCH_2COOH$ | 54 | $(C_{8-10}H_{17-21})—O(CH_2)_3—NH_2$ | 0.045 | 32.4 | 0.037 | 38.7 | 67.4 | 77.8 | 3.8 | 0.029 | 44.9 |
| 4 | $C_8H_{17}—CH=CH—C_7H_{15}—C(=O)—N(CH_3)—CH_2COOH$ | 54 | $(C_{8-10}H_{17-21})—O(CH_2)_3—NH_2$ | 0.043 | 32.4 | 0.034 | 40.7 | 66.0 | 80.2 | 5.7 | 0.024 | 42.3 |
| 5 | $C_{13}H_{27}—OCH_2CH(OH)CH_2N(CH_3)—CH_2COOH$ | 54 | $(C_{8-10}H_{17-21})—O(CH_2)_3—NH_2$ | 0.043 | 31.9 | 0.035 | 38.2 | 67.8 | 77.6 | 3.3 | 0.029 | 46.3 |
| 6 | 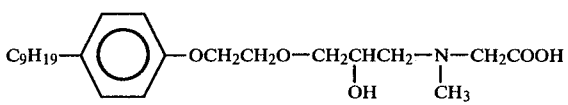 | 54 | $(C_{8-10}H_{17-21})—O(CH_2)_3—NH_2$ | 0.045 | 29.7 | 0.039 | 39.6 | 67.2 | 79.3 | 4.2 | 0.033 | 47.8 |
| 7 | $(C_8H_{17})_2—NCH_2PO_3H_2$ | 10 | $(C_{8-10}H_{17-21})—O(CH_2)_3—NH_2$ | 0.044 | 29.9 | 0.034 | 37.6 | 67.4 | 75.6 | 3.6 | 0.034 | 52.9 |
| 8 | $(C_8H_{17}—OCH_2CH(OH)CH_2)_2—NCH_2CH_2OPO_3H_2$ | 20 | $(C_{8-10}H_{17-21})—O(CH_2)_3—NH_2$ | 0.045 | 29.7 | 0.038 | 40.9 | 66.3 | 80.8 | 5.4 | 0.032 | 48.4 |
| 9 | $(C_8H_{17}—OCH_2CH(OH)CH_2)_2—NCH_2CH_2OPO_3H_2$ | 54 | $(C_{8-10}H_{17-21})—O(CH_2)_3—NH_2$ | 0.045 | 29.7 | 0.038 | 39.4 | 66.8 | 78.5 | 4.8 | 0.025 | 36.6 |
| 10 | $(C_8H_{17})_2—NCH_2CH_2OPO_3H_2$ | 54 | $(C_{8-10}H_{17-21})—O(CH_2)_3—NH_2$ | 0.046 | 28.4 | 0.042 | 39.2 | 66.5 | 77.8 | 5.4 | 0.034 | 44.9 |
| 11 | (2-ethyl hexyl-$OCH_2CH(OH)CH_2)_2—NCH_2CH_2OPO_3H_2$ | 54 | $(C_{8-10}H_{17-21})—O(CH_2)_3—NH_2$ | 0.044 | 28.3 | 0.038 | 38.9 | 66.3 | 76.8 | 5.0 | 0.028 | 39.7 |
| 12 | $C_{14}H_{29}OCH_2CH(OH)CH_2OCH_2C(=NC_2H_4OP(=O)(OH)_2)(OC_2H_5)$ | | $(C_{8-10}H_{17-21})—O(CH_2)_3—NH_2$ | 0.044 | 30.8 | 0.036 | 38.9 | 66.7 | 77.3 | 5.1 | 0.030 | 48.2 |

TABLE I-continued

| Example No. | Anionic Collector | g/ton | Primary Amine Collector | Feed % P Assay | Slimes % Wt. | Deslimed Pulp % P Assay | Iron mineral concentrate % Wt. | % Fe Grade | % Fe Recovery | % $SiO_2$ Assay | % P Assay | P distributed in % of flotation feed |
|---|---|---|---|---|---|---|---|---|---|---|---|---|
| 13 | $CHCH_2CHCH_2N(CH_3)-CH_2COOH$ (OH) | 54 | $(C_{8-10}H_{17-21})-O(CH_2)_3-NH_2$ | 0.045 | 31.4 | 0.035 | 40.3 | 65.4 | 78.5 | 4.2 | 0.030 | 52.1 |

By comparison with the Control, it is evident that Examples 1 to 11 carried out in accordance with the invention yield iron mineral concentrates with a low % P assay and a P distribution considerably lower than in the Control. This is achieved without undue losses of iron (see % Fe grade and recovery), and also with some improvement in the silicate flotation. Some of the tests show an iron recovery that is essentially superior to the results reported in Japanese patent applications Nos. 58-159,856 and 58-156,358.

The compound and the process of the invention is further illustrated by the following Example.

EXAMPLE 14

A. The amide $$C_{15}H_{31}\overset{\overset{\displaystyle O}{\|}}{C}-NHCH_2CH_2NHCH_2CH_2OH$$

was prepared by reacting 272 grams (1 mole) of $$C_{15}H_{31}\overset{\overset{\displaystyle O}{\|}}{C}-OCH_3$$

with 104 grams (1 mole) of aminoethyl ethanolamine $H_2NCH_2CH_2$—$NHCH_2CH_2OH$. The released methanol was distilled off at the end of reaction. After the reaction the reaction mixture was titrated and the amount of basic nitrogen was determined. The yield of the amide was about 93%.

The amide in an amount of 72 grams (0.2 mole) was then reacted with 35 grams of polyphosphoric acid at 85° C. for two hours.

Titration of the anionic group containing surface active compound confirmed the formation of $$C_{15}H_{31}\overset{\overset{\displaystyle O}{\|}}{C}-NHCH_2CH_2NHCH_2CH_2O\overset{\overset{\displaystyle O}{\|}}{P}(OH)_2.$$

The total yield was about 69%, and the reaction product obtained was a highly viscous mass, which was soluble in water after neutralization. B. The epoxide $$\text{2-ethylhexyl-}OCH_2\underset{\underset{\displaystyle O}{\diagdown\ \diagup}}{CHCH_2}$$

in an amount of 104 grams (0.48 moles) was reacted with aminoethyl ethanolamine in an amount of 25 grams (0.24 moles) for two hours at 70° C. with formation of the tertiary amine:

$$(\text{2-ethylhexyl-}OCH_2\underset{\underset{\displaystyle OH}{|}}{CHCH_2})_2NCH_2CH_2NHCH_2CH_2OH$$

The amination degree was determined by titration of tertiary nitrogen and was found to be about 91%.

50 grams (0.093 moles) of the tertiary amine was then reacted with 26 grams of polyphosphoric acid at 70° C. for two hours.

Titrimetric determination of the anionic group containing surface active compound confirmed the formation of the compound:

$$(\text{2-ethylhexyl-}OCH_2\underset{\underset{\displaystyle OH}{|}}{CHCH_2})_2NCH_2CH_2NHCH_2CH_2O\overset{\overset{\displaystyle O}{\|}}{P}(OH)_2$$

The product obtained was a highly viscous mass, soluble in water after neutralization.

C. Froth flotations were carried out in accordance with the flow sheet shown in FIG. 1, using the compounds of A and B.

An iron ore containing Fe 34%, Si 23.9% and P 0.044%, mainly present as hematite 49%, silicate (quartz) 51%, and apatite 0.24%, was crushed to particles less than 1.7 mm in diameter and homogenized. From the homogenized material portions of 600 grams each were taken out. The portions were further ground in a laboratory rod mill for 30 minutes together with 400 ml of water, 0.40 g sodium hydroxide and 0.27 g water glass (38% sodium silicate by weight, weight ratio $SiO_2$-$NaO_2$=3.22, 41.0° Be).

The particle distribution was such that 97% by weight passed through a 32μ mesh sieve.

An aqueous mineral pulp 8 liters in volume was prepared from each portion of the ground material. Temperature and pH were adjusted to about 20° C. and 10.5, respectively. 0.0675 g of prehydrolyzed corn starch was added, and the whole was conditioned in a paddle mixer for 2 minutes.

The conditioned pulp was allowed to settle for 3 minutes, and then the slime was siphoned off. The deslimed pulp was divided into four fractions and each fraction transferred to a flotation cell and diluted with water to a volume of 0.5 liter. The pH was adjusted to 10.5 with sodium hydroxide, followed by the addition of 0.0675 g of the prehydrolyzed corn starch. After conditioning for 2 minutes, and a final pH adjustment to 11.0, the anionic collector and primary amine collectors were added. The amount of the primary amine was 0.0067 g, and the amount of the anionic collector is given in Table I. After an additional conditioning for 2 minutes, a rougher flotation was carried out, giving a Froth Product 1 and a bottom iron mineral concentrate. The pH was again adjusted to 11 with sodium hydroxide 0.0067 g of primary amine was added to the bottom concentrate, and the whole conditioned for 2 minutes, followed by another froth flotation, giving a Froth Product 2, and iron mineral concentrate. The primary amines and anionic group-containing compounds used and the results obtained are shown in Table I.

D. Pure minerals composed of fluorapatite, calcite, scheelite, magnesite, quartz, olivine, and fluorite, respectively, were subjected to froth flotation. Firstly, the minerals were ground and wet-screened, and the fractions +250–400 μm were selected, to be used in the froth flotation trials. These fractions were added in an amount of 0.2 ml to test tubes having a diameter of 15 mm and a length of 120 mm. 10 ml of an aqueous fluid containing 0.01 g/l of a collector according to Table II, and having a pH of 8 or 11 were added, whereafter the minerals were conditioned for 5 minutes during stirring.

After the conditioning the water phase was sucked off and water under a pressure of 7 atm and saturated with air was injected via a lance. When the pressure of the water was reduced, the air was liberated and a froth flotation process took place. The amount of floated material was determined visually. The results are shown in Tables III and IV below.

TABLE I

| Example No. | Anionic Collector | g/ton | Primary Amine Collector | Feed % P Assay |
|---|---|---|---|---|
| Control | None | — | $(C_{8-10}H_{17-21})—O(CH_2)_3—NH_2$ | 0.043 |
| 14A | $CH_{15}H_{31}\overset{O}{\overset{\|\|}{C}}NHCH_2CH_2NHCH_2CH_2O\overset{O}{\overset{\|\|}{P}}(OH)_2$ | 40 | $(C_{8-10}H_{17-21})—O(CH_2)_3—NH_2$ | 0.049 |
| 14B | $(2\text{-ethylhexyl-}OCH_2\underset{\underset{OH}{\|}}{C}HCH_2)_2NCH_2CH_2\underset{\underset{\underset{\underset{\underset{O=P(OH)_2}{\|}}{O}}{\|}}{CH_2}}{\underset{\underset{CH_2}{\|}}{\|}}{NH}$ | 42 | $(C_{8-10}H_{17-21})—O(CH_2)_3—NH_2$ | 0.046 |

| Example No. | Slimes % Wt. | Deslimed Pulp % P Assay | Iron mineral concentrate % Wt. | % Fe Grade | % Fe Recovery | % $SiO_2$ Assay | % P Assay | P distribution in % of flotation feed |
|---|---|---|---|---|---|---|---|---|
| Control | 32.2 | 0.033 | 37.9 | 66.0 | 74.7 | 5.8 | 0.048 | 81.6 |
| 14A | 32.0 | 0.037 | 44.4 | 62.7 | 81.1 | 9.4 | 0.031 | 58.7 |
| 14B | 32.0 | 0.031 | 37.4 | 65.7 | 71.5 | 5.2 | 0.024 | 40.9 |

TABLE II

| Example No. | Collector |
|---|---|
| 14C | $C_{17}H_{33}—\overset{O}{\overset{\|\|}{C}}—N(C_2H_4)_2N—C_2H_4OPO_3Na$ |
| 14D | $(2\text{-ethylhexyl-}OCH_2\underset{\underset{OH}{\|}}{C}HCH_2)_2NC_2H_4NHC_2H_4OPO_3Na$ |
| 14E | $C_{17}H_{33}—\overset{O}{\overset{\|\|}{C}}—NHC_2H_4NHC_2H_4OPO_3Na_2$ |
| 14F | $(C_8H_{17})_2—NC_2H_4—\overset{C_8H_{19}}{\overset{\|}{N}}—C_2H_4OPO_3—Na_2$ |
| 14G | $C_{15}H_{31}CH_2\underset{\underset{OH}{\|}}{C}HCH_2NHC_3H_6—\overset{CH_3}{\overset{\|}{N}}—C_2H_4OPO_3—Na_2$ |
| Control | |
| A | $C_{15}H_{31}\overset{O}{\overset{\|\|}{C}}—\overset{CH_3}{\overset{\|}{N}}—CH_2COONa$ |
| B | $C_{17}H_{33}OCH_2\underset{\underset{OH}{\|}}{C}HCH_2—\overset{CH_3}{\overset{\|}{N}}—CH_2—COONa$ |

TABLE III

| Example No. | % Floated mineral, pH 8 14C | 14D | 14E | 14F | 14G | Control A | Control B |
|---|---|---|---|---|---|---|---|
| Fluorapatite | 85 | 100 | 100 | 50 | 100 | 15 | 35 |
| Calcite | 85 | 50 | 25 | 50 | 50 | 25 | 0 |
| Dolomite | 15 | 65 | 25 | — | — | 0 | 0 |
| Fluorite | 100 | 100 | 100 | — | — | 100 | 100 |
| Scheelite | 15 | 65 | 15 | — | — | 0 | 15 |
| Baryte | 25 | 75 | 75 | — | — | 25 | 15 |
| Quartz | 25 | 15 | 100 | 100 | 15 | 0 | 15 |
| Magnesite | 15 | 0 | 0 | — | — | 0 | 0 |
| Olivine | 25 | 85 | 100 | — | — | 15 | 0 |

TABLE IV

| Example No. | % Floated mineral, pH 11 14C | 14D | 14E | 14F | 14G | Control A | Control B |
|---|---|---|---|---|---|---|---|
| Fluorapatite | 25 | 100 | 85 | 100 | 100 | 15 | 25 |
| Calcite | 0 | 25 | 85 | 25 | 25 | 0 | 0 |
| Dolomite | 25 | 25 | 85 | — | — | 15 | 0 |
| Fluorite | 65 | 85 | 100 | — | — | 85 | 100 |
| Scheelite | 25 | 65 | 75 | — | — | 25 | 15 |
| Baryte | 15 | 25 | 65 | — | — | 0 | 15 |
| Quartz | 0 | 0 | 15 | 25 | 10 | 0 | 0 |
| Magnesite | 0 | 0 | 0 | — | — | 0 | 0 |
| Olivine | 0 | 15 | 0 | — | — | 0 | 0 |

Having regard to the foregoing disclosure, the following is claimed as the patentable and inventive embodiments thereof:

1. A process for the froth flotation beneficiation of iron minerals from iron ores containing silicate and phosphate minerals while preferentially and selectively floating the silicate and phosphate minerals while not floating the iron minerals, which comprises carrying out the flotation in the presence of an anionic group containing compound $$R_5—[O]_{m6}—[C_{n3}H_{2n3}O]_{m3}—[CH_2\underset{\underset{OH}{\|}}{C}HCH_2]_{m4}—[X]_{m5}—\overset{R_6}{\overset{\|}{N}}—C_pH_{2p})_q—\overset{R_7}{\overset{\|}{N}}—C_2H_4OPO_3M_2$$

in which:

$R_5$ is a hydrocarbon group having from about five to about twenty-four carbon carbon atoms;

X is a group $$—\underset{\underset{O}{\|}}{C}— \quad \text{or} \quad —OCH_2\underset{\underset{O}{\|}}{C}—$$

$n_3$ is a number from 2 to 4;

$m_3$ is a number from 0 to 5, and can be an average number;

$m_4$ is 0 to 1;

$m_5$ is 0 or 1;

$m_6$ is 0 or 1;

when $m_3$ and $m_4$ are 0, $m_6$ is 0;

p and q are numbers from 1 to 3;

$R_6$ and $R_7$ are selected from the group consisting of hydrogen; hydrocarbon groups having from one to about twelve carbon atoms; and $$R_5[O]_{m6}-[C_{n3}H_{2n3}O]_{m3}-[CH_2-\underset{\underset{OH}{|}}{CH}-CH_2]_{m4}-[X]_{m5}-;$$

$$\overset{R_6}{\overset{|}{N}}-(C_pH_{2p})_q-\overset{R_7}{\overset{|}{N}}$$

can be taken together as

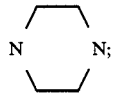

and

M is a monovalent inorganic or organic cation or hydrogen;

and removing the floated silicate and phosphate minerals leaving the beneficiated nonfloated iron minerals.

2. A process according to claim 1 in which there is also present during flotation a primary amine having the formula $$R_1-[OC_{n1}H_{2n1}]_{m1}-[NHC_{n2}H_{2n2}]_{m2}-NH_2 \qquad \text{I}$$

in which:

$R_1$ is a hydrocarbon group having from about six to about eighteen carbon atoms;

$n_1$ and $n_2$ are 2 or 3; and $m_1$ is from 0 to 4, and $m_2$ is from 0 to 2.

* * * * *